US008398255B2

(12) United States Patent
Starogiannis

(10) Patent No.: US 8,398,255 B2
(45) Date of Patent: Mar. 19, 2013

(54) WRIST FLEX FLASHLIGHT

(76) Inventor: Athanasios T. Starogiannis, Wake Forest, NC (US)

( * ) Notice: Subject to any disclaimer, the term of this patent is extended or adjusted under 35 U.S.C. 154(b) by 402 days.

(21) Appl. No.: 12/862,984

(22) Filed: Aug. 25, 2010

(65) Prior Publication Data

US 2012/0051033 A1 Mar. 1, 2012

(51) Int. Cl.
*F21V 21/08* (2006.01)

(52) U.S. Cl. ..... 362/103; 2/160

(58) Field of Classification Search ..... 362/103, 362/251, 570, 108, 191, 190, 234; 2/160, 2/159, 251, 247

See application file for complete search history.

(56) References Cited

U.S. PATENT DOCUMENTS

| | | | |
|---|---|---|---|
| 3,112,889 A | 12/1963 | Marmo et al. | |
| 4,788,631 A | 11/1988 | Fuller | |
| D361,143 S | 8/1995 | Helvey | |
| 6,550,930 B1 | 4/2003 | Portouche | |
| 2005/0254229 A1 | 11/2005 | Hamade et al. | |
| 2006/0109645 A1 | 5/2006 | Ferrari et al. | |
| 2011/0182057 A1* | 7/2011 | Watson | 362/103 |

FOREIGN PATENT DOCUMENTS

| | | |
|---|---|---|
| JP | 2002203401 A | 7/2002 |
| JP | 2002538577 A | 11/2002 |
| WO | 0214737 A2 | 2/2002 |

OTHER PUBLICATIONS

Carpus, Wikipedia, http://en.wikipedia.org/wiki/Wrist_bone, Jun. 19, 2010.

Flexion/Extension Wrist motions, Jun. 19, 2010.

Search Report and Opinion for the corresponding PCT Application No. PCT/US2011/049055.

* cited by examiner

*Primary Examiner* — Anh Mai
*Assistant Examiner* — Elmito Breval
(74) *Attorney, Agent, or Firm* — James G. Passé; Passé Intellectual Property, LLC

(57) ABSTRACT

The present invention relates to a wrist flashlight. The flashlight of the present invention sits partly on the wrist and partly on the hand and flexes at the wrist joint such that the beam of light is always pointing in the same direction as the hand.

9 Claims, 4 Drawing Sheets

WRIST FLEX FLASHLIGHT

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to flashlights, particularly for wrist mounting. In particular, it relates to a flashlight for mounting across the wrist and hand which flexes with the movement of the hand.

2. Description of Related Art

It is not an infrequent occurrence that people need to use a flashlight while both hands are performing a task and a regular flashlight cannot be held or a second person is not available to hold a flashlight for that person. There are a wide variety of situations that this occurs for and one solution is to mount a flashlight on the wrist. Wrist mounting of flashlights has been known since at least the early 1960's and whether the flashlight is mounted on the top of the wrist or the palm side of the wrist depends on the object or task needing to be lit.

Wrist top or side mounted flashlights are designed to light objects and the like away from the hands and not what the hands are holding or doing. The flashlight is mounted with the bulb facing distal to the arm and can be used in a variety of situations to basically see where the individual is going, rather than what's in the person's hands. In U.S. Pat. No. 3,112,889 to Mario issued Dec. 3, 1963 describes a flashlight that has a strap positioned around the wrist and the light housing spans the wrist and the back of the hand. The flashlight is described as useful, for example, for milkmen to look in the delivery box while holding the milk delivery. A problem with this design is that the positioning of this type of light interferes with wrist extension and to the extent the wrist can perform extension, it interferes/blocks the beam of light from the flashlight.

One solution to side wrist mounted flashlights being used is to allow the position and direction of the light to be flexible. The user moves the light on a swivel or hinge until the desired position is reached and then the light is left in this position during use. In WO 02/14737 Lee, published Feb. 21, 2002, there is a wrist flashlight shown mounted to the side of the wrist with a ball and socket hinge. The housing is designed to be positioned from the wrist and proximal thereto with the light on top of the housing which allows positioning of the direction of the light. Likewise, in U.S. Pat. No. 6,550,930 to Portouch issued Apr. 22, 2003, there is a flashing designed for mounting on top of the wrist from the wrist proximal thereto where the light bulb is in a hinged housing. These flashlights still have the problem of wrist extension interfering with a forward directed light beam. In addition, when the light needs to be repositioned during hand and body movement, one needs to have the hands free to make an adjustment.

If one wishes to light the hands while they are working, for example, during plumbing, carpentry, or other activities where one needs to see what the hands are doing in a poorly lit situation, a light would be mounted on the underside of the wrist. The above art does not teach use on the bottom of the wrist. This is mainly because the movement of the hand during flexion interferes with the light beam and while at least one inventor has suggested such use, it is clear that illumination of the fingers is only effective if the user keeps the wrist in a neutral position. In U.S. Pat. No. 4,788,631 to Fuller issued Nov. 29, 1988, a flashlight for the lower wrist is described for lighting the "fingertips", however, as noted the flexion and extension of the wrist misdirects or blocks a beam of light.

It's clear that while wrist flashlights have been available in design for sometime, a flashlight that can be utilized on the underside of the wrist for lighting the hands during complex movements with cause flexion and extension movements is not available in the art.

BRIEF SUMMARY OF THE INVENTION

The present invention relates to a wrist flashlight that lights the hand as the wrist/hand it is mounted to operates a flexion or extension movement, thus allowing the hand to be lit while performing complex hand movements. The flashlight bridges the wrist and hand with a spring loaded hinge, positioned at the wrist so that as the wrist moves, the direction of the light tracks that movement. It's also clear the device could be located on top of the wrist where the user desires the light to point where the top of the hand is directed during movement or relaxed positioning.

In one embodiment of the invention there is a battery operated wrist flashlight for mounting to the underside of a wrist and spanning the wrist, wrist joint, and hand of a user comprising:

a) a bulb housing comprising a battery operated bulb capable of producing a light beam;

b) a wrist housing capable of attaching to the underside of a wrist; and c) a spring hinge between the bulb housing and wrist housing designed such that when the flashlight is mounted to the underside of a wrist with the bulb housing on a hand, the wrist housing on a wrist, and the spring hinge on the wrist joint of a user; the light beam shines in a direction distal to the wrist and the flexion or extension of the hand of the user moves the bulb housing in hinged alignment with the hand and wrist joint.

DETAILED DESCRIPTION OF THE INVENTION

Figure 1A:
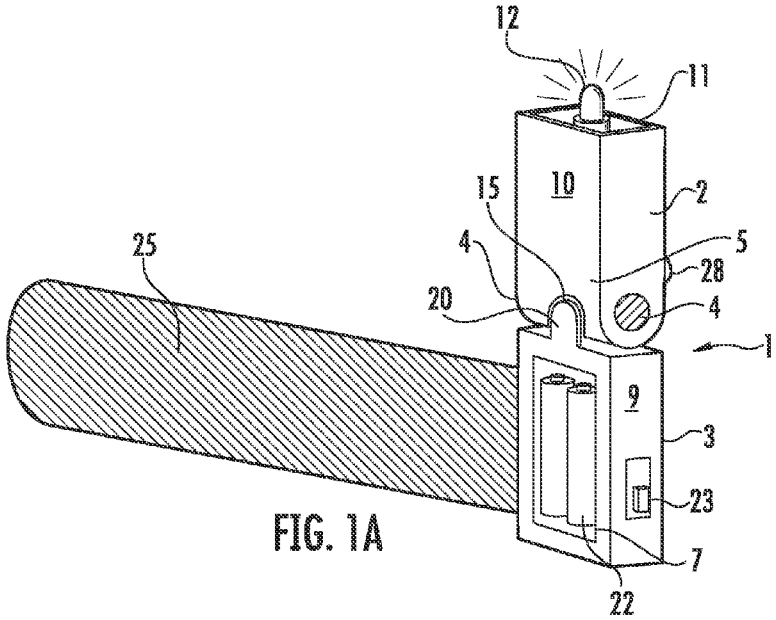
FIGS. 1*a* and 1*b* are perspective views of the front and back of the device of the invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "flashlight" refers to a battery operated device which has a battery operated light bulb capable of producing a light beam. It comprises a means for turning the device on and off such as a switch, tightening a connection (for instance by twisting a lens cover), or the like. Turning the switch on delivers battery power to the light bulb which then lights as long as the switch is on. It may also have a lens for focusing or protecting the light bulb from damage and which can be clear or colored as desired. The bulb can be an incandescent bulb, an LED, or the like and in some embodiments it can be a plurality of bulbs. In one embodiment, there are 2 or more LED light bulbs powered by batteries.

As depicted in the drawings and their description which follows, the particular flashlight of the present invention is a wrist flashlight. Unlike typical wrist flashlights which are either positioned on top of the wrist or on the wrist entirely behind the wrist joint, the present invention is positioned on the underside of the wrist spanning the wrist joint and also being positioned on hand. As will be described further in detail and shown in the drawings, the device allows the user to flex the hand at the wrist joint in either a flexion or extension manner and the beam of light will continue to follow the direction the hand has moved.

As used herein the term "bulb housing" refers to the portion of the device which, when in use, is situated on the hand (the underside or palm side when the device is mounted on the underside of the wrist). It contains a battery operated light bulb on the housing situated such that the beam of light it produces shines distal to the wrist or toward the fingertips of the hand. The housing can contain bulb reflectors, lens, an on/off switch, battery, or any accessories necessary. While the battery can be in this portion since the wrist housing is stationary, one might in some embodiments locate the batteries there with an electrical connection between the wrist housing and the bulb to provide an electrical connection.

In one embodiment of the present invention, the bulb housing can contain a slider system. As used herein the "slider system" is a device or material situated on the bulb housing in the position where it contacts the hand of the user and reduces friction to prevent abrasion or blistering from frequent position changes of the bulb housing as it moves from the extension position to the flexion position. The slider system in one embodiment is a small roller which contacts the skin as it rolls in either direction as the housing flexes about the spring hinge. In other embodiments, it's a patch of polymer with a low coefficient of friction, such as Teflon or smooth nylon plastic, which will allow the device to smoothly move against the skin of the user. Other sliding type polymers could also be utilized and low coefficient of friction devices and polymers would be clear from the disclosure and the invention disclosed herein. The size of the bulb housing is such that it does not extend to or interfere with the fingers or their use. In general the bulb housing is about 1 inch to about 3 inches in length.

As used herein the "wrist housing" is the portion of the device which is situated over the wrist just behind the wrist joint. It can be as big or as small as necessary to be attached to the wrist, contain the battery when it is in this housing, attach a strap, wrist band or other device to attach the device to the wrist, an electrical connection to the bulb when the batteries are here, an on/off switch and the like. It can be as wide as the wrist, up to 3 or 4 inches wide, but can also be narrow, as little as half an inch, an inch, or the like. The length would be at least about an inch and while it could be as long as the forearm, a foot or so, 1 to 3 or 4 inches is sufficient for the device to work.

The bulb housing and the wrist housing are connected via a spring hinge. The wrist housing is positioned on and attached to the wrist and becomes immobile. The bulb portion position on the hand can then flex as the hand flexes at the wrist joint forward and back. The hinge is positioned over the wrist joint and the spring is biased in one direction, i.e. one needs to push it in one direction and the spring pushes it back. Thus, when positioned on the hand, flexion movement of the hand pushes against the spring moving the bulb housing with the hand movement and the compression of the spring in the other direction causes the bulb housing to move with the hand in extension movements. The hinge can be a pin axel positioned through each of the housings (as shown in the figures, for example). In other embodiments it can be a separate spring hinge with one side attached to the bulb housing and the other to the wrist housing. The spring and its position are easily placed to cause this action and a suitable coil spring, leaf spring, or the like can be positioned as can other spring means in light of this teaching.

In one embodiment of the present invention, there is a travel stop controlling the hinge. A travel stop is used to adjust the furthest limit of the spring or the hand moving the bulb housing in one direction or the other. A travel stop can be a nub, design of the hinge itself, or can be a physical stop installed on the wrist housing or the like. Travel stops are within the skill of the art once this teaching and invention are understood.

As described above once the device is in place on a user, the bulb housing moves in hinged alignment with the hand movement flexion and extension. The "hinged alignment" allows the bulb to shine on the fingers in the same place no matter where the hand is flexing back and forth at the wrist joint.

Now referring to the drawings, FIG. 1*a* is a perspective front view of an embodiment of the present invention with the batteries exposed (one would normally place a battery cover over them but they are exposed for clarity). Wrist flex flashlight 1 consists of the bulb housing 2, wrist housing 3, hinge pin 4, and spring 5.

The bulb housing 2 consists of main unit 10 which holds any of the wiring for bulb holder 11 and bulb 12. Bulb 12 in this embodiment is an LED but could be any light bulb. An advantage of the LED is it does not get as hot and is less likely to burn the user. Note that while this embodiment shows the bulb exposed for clarity, the light bulb could be contained within the main unit 10 and further covered with a lens.

The housing 10 has the hinge pin 4 pushed through a hole horizontally from one side to another. The accepter cut out 15 is to allow the mating portion 20 from the wrist housing 3 to fit in the cut out 15 and allow the hinge pin to pass through both the housing 10 and mating portion 20 and for a hinge to fit between them. The spring 5 is set up so that it is biased in one direction and requires force to move in the other direction as further explained in the flowing figures.

The wrist housing 3 consists of a shell 9. Batteries 22 are placed in a compartment 7 in the shell 9 of the wrist housing 3 and powers the bulb 12 in the bulb housing 2 by means of wires (not shown) in the standard method for battery powering a flashlight. The on/off switch 23 allows the power to be turned on and off though any means (including pulling a battery out) that can be used to turn the flashlight on or off. Wrist strap 25 is designed to wrap around a user's wrist and attach the wrist housing to the wrist. The strap 25 can be Velcro (hook and loop fastener), an elastic band, a wristwatch type pin and hole band, or the like. Essentially any method for holding the flashlight in place by attachment of the wrist housing 3 to a user's wrist is within the scope of the invention. The embodiment shown is for exemplification of an embodiment.

In one embodiment a slider system is utilized to aid in reducing friction against the user's hand. A roller 28 is partially shown in this view which is capable of rolling in both directions as the bulb housing is moved back and forth using the hinge pin 4 as the fulcrum.

Figure 1B:
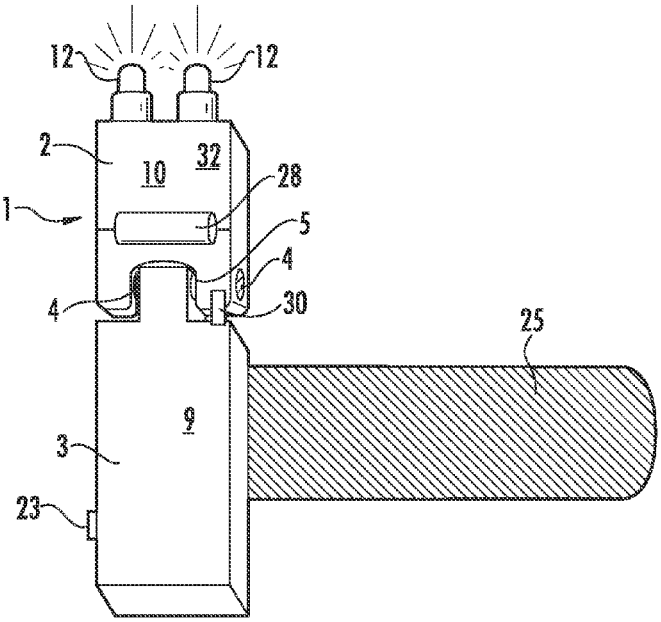

FIG. 1*b* the back side view of a wrist flex flashlight 1 is shown. The back side 32 of the bulb housing is the side that faces a user's hand (palm) during use of the flashlight 1. The roller 28 is designed to reduce friction against the user's hand. Note, in this embodiment as well there are two LED bulbs 12 to increase the light generated by the flashlight 1.

Figure 2A:
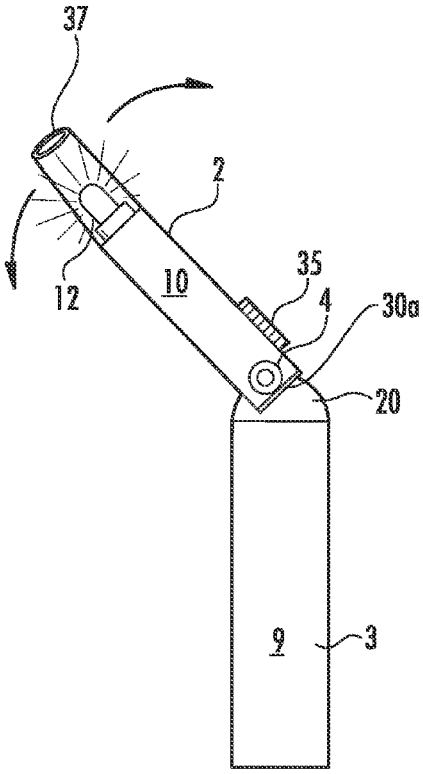
FIGS. 2*a*, 2*b* and 2*c* are side views of the flashlight in different angled positions.
Figure 2B:
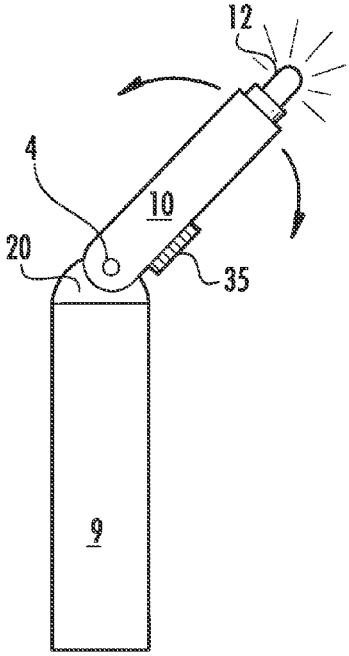
Figure 2C:
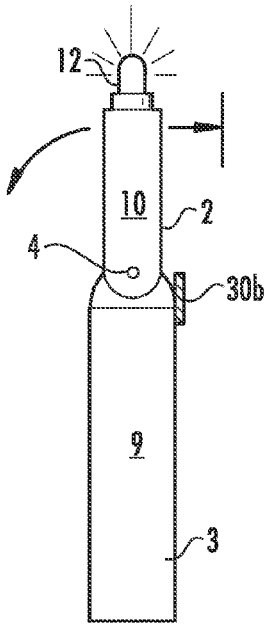

FIGS. 2*a*, 2*b*, and 2*c* show how the bulb housing 2 flexes via the hinge 4 relative to the wrist housing. This embodiment shows another slider system embodiment, namely a polymeric nylon pad 35 for sliding against the skin. Also shown is lens 37 for focusing and/or protecting the bulb 12. This version also has a design of stop 30*a* built into bulb housing 2 so that in this embodiment the bulb housing cannot travel past a vertical position. In embodiments without the stop 30*a* as shown in FIG. 2*a*, the bulb housing can flex past the upright in the opposite direction. FIG. 2*c* shows another stop 30*b* which is a physical addition to the wrist housing. Such a stop could be made to swivel or adjust such that it could be utilized or not, or the actual stop position adjusted. Such construction would be within the skill in the art in view of this disclosure.

Figure 3:
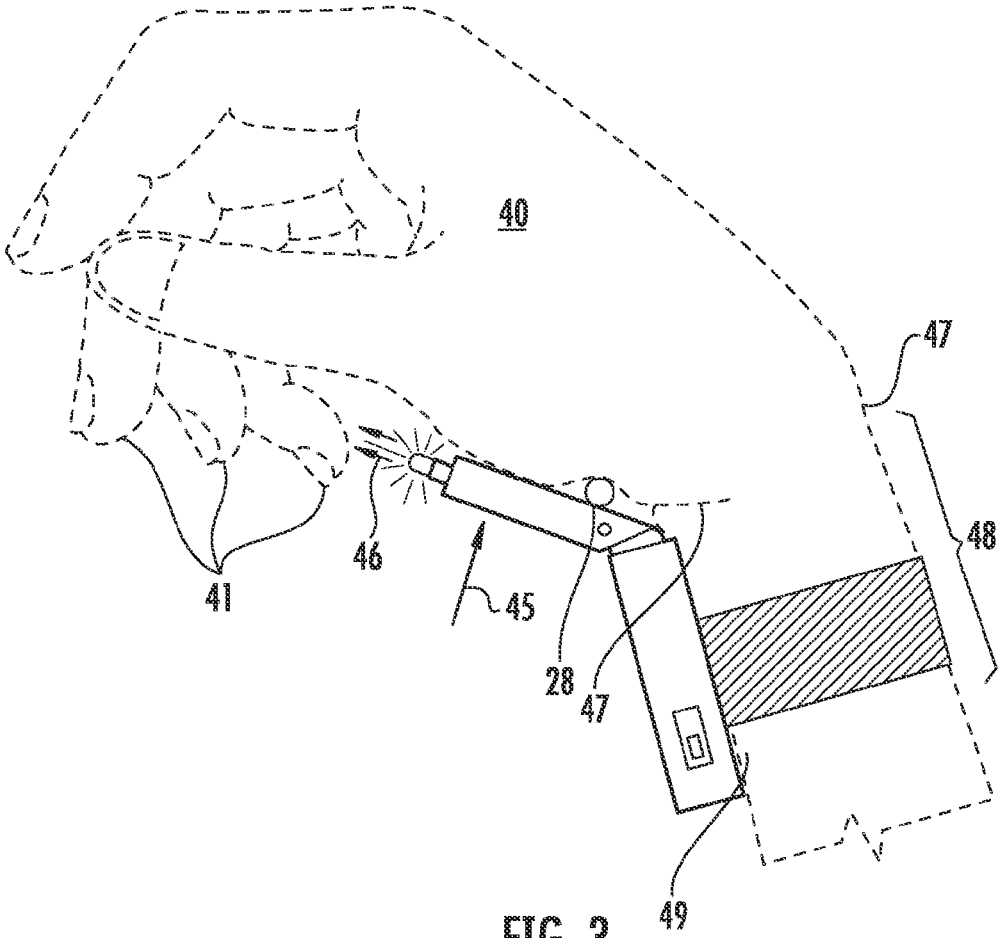
FIG. 3 is a perspective view of the flashlight on a wrist with the hand in flexion position.
Figure 4:
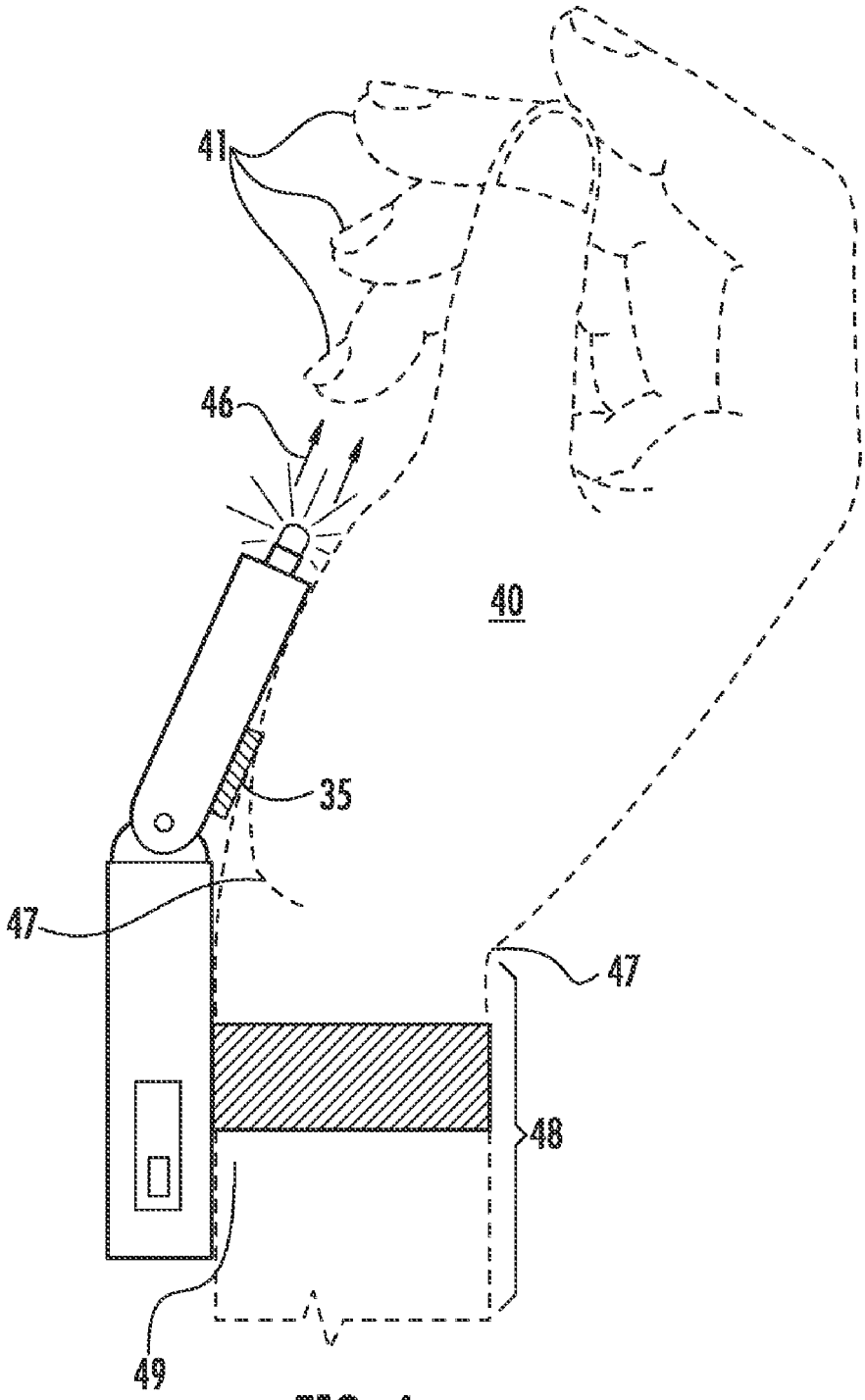
FIG. 4 is a perspective view of the flashlight on a wrist with the hand in extension position.

FIGS. 3 and 4 depict user's hand 40 in flexion position FIG. 3 and extension position FIG. 4. Shown are the hand 40, the wrist joint 47, and the wrist 48. In this view, the flashlight is attached to wrist 48 on the underside 49. One can clearly see that in both positions the light from bulb 12 indicated by arrow 46 shines on the fingers 41 regardless of which position the hand 40 is in. One looking at the prior art wrist flashlights can plainly see that such is not accomplished by these flashlights. The prior art flashlights only shine in the direction the wrist is pointed and not the direction of the hand itself. The spring 5 (shown in other figures) is biased in this example in direction 45. The user's hand 40 moving from the position in FIG. 3 to that of FIG. 4 would have the bulb housing move with the hand by the action of that spring moving the bulb housing 2. When the hand 40 moves from the position in FIG. 4 back to the position in FIG. 3, the force of the hand 40 in that movement pushes on the bulb housing 2 forcing it to the position in FIG. 3 by acting against the force of the spring.

These two figures also show the positioning of the two embodiments of slider systems up against hand 40 which reduce friction of the movement of the bulb housing 2. As the hand 40 moves between flexion and extension the bulb housing will tend to rub against the hand at the contact point and by placement of the slider system at the contact point with the hand friction is greatly reduced.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A battery operated wrist flashlight for mounting to the underside of a wrist and spanning the wrist, wrist joint and hand of a user comprising:

a) a bulb housing comprising a battery operated bulb capable of producing a light beam;

b) a wrist housing capable of attaching to the underside of a wrist; and c) a spring hinge between the bulb housing and wrist housing designed such that when the flashlight is mounted to the underside of a wrist with the bulb housing on a hand, the wrist housing on a wrist, and the spring hinge on the wrist joint of a user; the light beam shines in a direction distal to the wrist and the flexion or extension of the hand of the user moves the bulb housing in hinged alignment with the hand and wrist joint.

2. A wrist flashlight according to claim 1 wherein the bulb is at least one LED bulb.

3. A wrist flashlight according to claim 1 wherein the wrist housing is capable of being attached to a wrist by a wrist band.

4. A wrist flashlight according to claim 1 wherein the wrist housing contains a battery for operating the bulb.

5. A wrist flashlight according to claim 1 wherein the wrist housing comprises a switch for turning the bulb on and off.

6. A wrist flashlight according to claim 1 wherein the bulb housing further comprises a slider system for decreasing friction of the bulb housing against a hand during use.

7. A wrist flashlight according to claim 6 wherein the slider system comprises at least one roller.

8. A wrist flashlight according to claim 6 wherein the slider system comprises a low friction polymer.

9. A wrist flashlight according to claim 1 wherein the spring hinge further comprises a travel stop.

* * * * *